US009360288B2

(12) United States Patent
Zierden et al.

(10) Patent No.: US 9,360,288 B2
(45) Date of Patent: Jun. 7, 2016

(54) FIRE IGNITION FLARE SYSTEM AND METHOD

(71) Applicant: Firepoint Products, Inc., Orlando, FL (US)

(72) Inventors: Neil Zierden, Leesburg, FL (US); Rhonda Zierden, Leesburg, FL (US)

(73) Assignee: FIREPOINT PRODUCTS, INC., Tavares, FL (US)

( * ) Notice: Subject to any disclaimer, the term of this patent is extended or adjusted under 35 U.S.C. 154(b) by 0 days.

(21) Appl. No.: 13/804,981

(22) Filed: Mar. 14, 2013

(65) Prior Publication Data

US 2014/0261041 A1 Sep. 18, 2014

(51) Int. Cl.

| | |
|---|---|
| ***F42B 4/26*** | (2006.01) |
| ***F42B 12/42*** | (2006.01) |
| ***F42B 12/44*** | (2006.01) |
| ***F42B 4/30*** | (2006.01) |
| ***F42B 12/02*** | (2006.01) |
| ***F42B 12/74*** | (2006.01) |
| ***F42B 33/00*** | (2006.01) |

(52) U.S. Cl.

CPC . *F42B 12/44* (2013.01); *F42B 4/26* (2013.01); *F42B 4/30* (2013.01); *F42B 12/02* (2013.01); *F42B 12/42* (2013.01); *F42B 12/745* (2013.01); *F42B 33/001* (2013.01)

(58) Field of Classification Search

CPC ..... F42B 4/26; F42B 4/30; F42B 12/02; F42B 12/42; F42B 12/44; F42B 12/74; F42B 12/745; F42B 4/00; F42B 4/02; F42B 4/04

USPC ..... 102/336, 364, 346, 361, 335; 42/1.15

See application file for complete search history.

(56) References Cited

U.S. PATENT DOCUMENTS

| | | | | | |
|---|---|---|---|---|---|
| 228,760 | A * | 6/1880 | Hunt | F42B 4/00 | 102/205 |
| 262,440 | A * | 8/1882 | Linton | F42B 4/00 | 102/335 |
| 692,769 | A * | 2/1902 | Delbrande | F42B 4/26 | 102/336 |
| 1,486,014 | A * | 3/1924 | Dutcher | F42B 4/26 | 102/336 |
| 1,792,246 | A * | 2/1931 | Mont | F42B 4/04 | 102/361 |
| 1,811,716 | A * | 6/1931 | Duncan | G08B 17/08 | 102/346 |
| 2,754,761 | A | 7/1956 | Dodds | | |
| 3,323,456 | A | 6/1967 | Rothman | | |
| 3,457,860 | A * | 7/1969 | Allen | | 102/346 |

(Continued)

FOREIGN PATENT DOCUMENTS

| | | | | |
|---|---|---|---|---|
| CH | 674770 A5 * | 7/1990 | | F42B 4/00 |
| WO | WO 2005094413 A2 * | 10/2005 | | |

OTHER PUBLICATIONS

International Search Report for PCT/US2014/027239; 11th Sep. 2014.*

(Continued)

*Primary Examiner* — James S Bergin

(74) *Attorney, Agent, or Firm* — Duane Morris LLP; Gregory M. Lefkowitz

(57) ABSTRACT

A fire ignition flare is described. The fire ignition flare includes an elongated, combustible body with a fuse extending longitudinally through the combustible body. A first end of the combustible body can include a concave portion. The combustible body can be bonded to the fuse along a bonded portion, and the fuse can extend from the concave portion.

15 Claims, 8 Drawing Sheets

(56) References Cited

U.S. PATENT DOCUMENTS

| | | | | |
|---|---|---|---|---|
| 3,494,283 | A | 2/1970 | Cronk | |
| 3,499,385 | A | 3/1970 | Douda | |
| 3,715,984 | A | 2/1973 | Murray | |
| 3,830,671 | A * | 8/1974 | McArdle | 149/2 |
| 3,893,396 | A | 7/1975 | Simmons | |
| 3,938,444 | A * | 2/1976 | Foote et al. | 102/283 |
| 3,976,008 | A * | 8/1976 | Altschuler | F42B 4/00 102/205 |
| 3,979,850 | A * | 9/1976 | Schiessl et al. | 42/71.02 |
| 4,005,656 | A | 2/1977 | Gellerstedt et al. | |
| 4,015,355 | A * | 4/1977 | Schiessl et al. | 42/105 |
| 4,106,411 | A | 8/1978 | Borcher et al. | |
| 4,579,059 | A | 4/1986 | Flatau | |
| 5,159,152 | A | 10/1992 | Pujols | |
| 5,739,461 | A | 4/1998 | Jacobson | |
| 5,783,768 | A | 7/1998 | Jacobson | |
| 5,997,667 | A | 12/1999 | Jacobson | |
| 6,128,845 | A | 10/2000 | Jacobson | |
| 6,170,399 | B1 * | 1/2001 | Nielson et al. | 102/336 |
| 7,261,037 | B2 | 8/2007 | Joseph, Jr. | |
| 8,316,768 | B2 * | 11/2012 | Reistroffer | C06B 45/00 102/275.11 |
| 2002/0066504 | A1 * | 6/2002 | Nopper | 149/19.91 |
| 2012/0118192 | A1 | 5/2012 | Nopper | |

OTHER PUBLICATIONS http://rxfire.us/page2.html—three video clips showing inventor Peter Nopper with the ForesTorch Fire Ignition Flare, circa 2009.*

Jim Tour & Sunni Bradshaw, "Ground Ignition Test Results," United States Department of Agriculture, Technology & Development Program, Missoula, Montana 59801, Nov. 1995.

Letter, dated Jan. 26, 2015, from Petter Nopper to Gregory M. Lefkowitz and J. Rodman Steele, Jr., U.S. Appl. No. 13/804,981.

Screen shot from video of Peter Nopper, purportedly circa 2009, purportedly captured and narrated by Neil Zierden.

Screen shot from video of Peter Nopper using an adhesive foil, purportedly circa 2009, purportedly captured and narrated by Neil Zierden.

Screen shot from video of Peter Nopper igniting a flare, purportedly circa 2009, purportedly captured and narrated by Neil Zierden.

Screen shot of Peter Nopper's website, purportedly circa 2005, regarding "Tactical Ignition Tool."

Purported "Selected, pertinent, date stamped excerpts from Nopper's lab notes," as identified by Peter Nopper.

Email from <fireinv@comcast.net> to <rconcoby@ecologic-restoration.com> and cc to <forestech@rxfire.us>, dated Apr. 16, 2009.

Email from "gooseneck"<gooseneck171@yahoo.com>, sent Aug. 4, 2009, purportedly containing a letter, dated Dec. 8, 2003, from Hattie L. Mitchell of the US Department of Transportation, Ref. No. 03-0256 to Peter Nopper.

Letter, dated Dec. 8, 2003, from Hattie L. Mitchell of the US Department of Transportation, Ref. No. 03-0256 to Peter Nopper.

Letter, dated Jul. 19, 2005, from Leslie Anderson, File Code: 5100, to Peter Nopper.

Video, entitled "ForesTorch Inventor," available at https://www.youtube.com/watch?v=__5hivYuV9Xs, published on Feb. 10, 2015, but purportedly available circa 2009.

Video, entitled "ForesTorch Tactical Ignition Tool for Prescribed Fire," available at https://www.youtube.com/watch?v=Y1i8kHZpE5g, published on Jan. 1, 2015, but purportedly available circa 2009.

* cited by examiner

FIRE IGNITION FLARE SYSTEM AND METHOD

FIELD OF THE INVENTION

This invention is directed generally to firefighting techniques and, more particularly, to fire ignition devices for prescribed burns.

BACKGROUND

Prescribed or controlled burning is a technique used by firefighting professionals in forestry or other wildland management for various measures including fire containment, fire prevention and vegetation control. For the safety of the fire personnel, prescribed fires may be ignited remotely using hand-thrown or mechanically-launched flares. Conventional flares often include hazardous materials and have limited trajectories. While conventional flares are useful in some instances, there are still numerous deficiencies and the potential for more useful fire ignition devices.

SUMMARY OF THE INVENTION

One of the broader forms of the present disclosure relates to a fire ignition flare including an elongated, combustible body and a fuse extending longitudinally through the combustible body. The combustible body can be bonded to the fuse along a bonded portion. A first end of the combustible body can include a concave portion, and the fuse can extend from the concave portion.

Another of the broader forms of the present disclosure relates to a method of igniting a backfire. The method includes providing a launching device with a barrel adapted for firing a projectile, loading a charge into the launching device, loading a fire ignition flare into the launching device, and discharging the fire ignition flare toward an area in need of a backfire.

Another of the broader forms of the present disclosure relates to a method of making a fire ignition flare. The method includes providing a fuse, providing a curable composition, and immersing at least a portion of the fuse in the curable composition. Finally, the curable composition can be cured around the fuse. The curable composition can include a curable resin, a hardener, and an oxidizer. The curable composition can also include a curable resin, a hardener, an oxidizer, and a catalyst.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
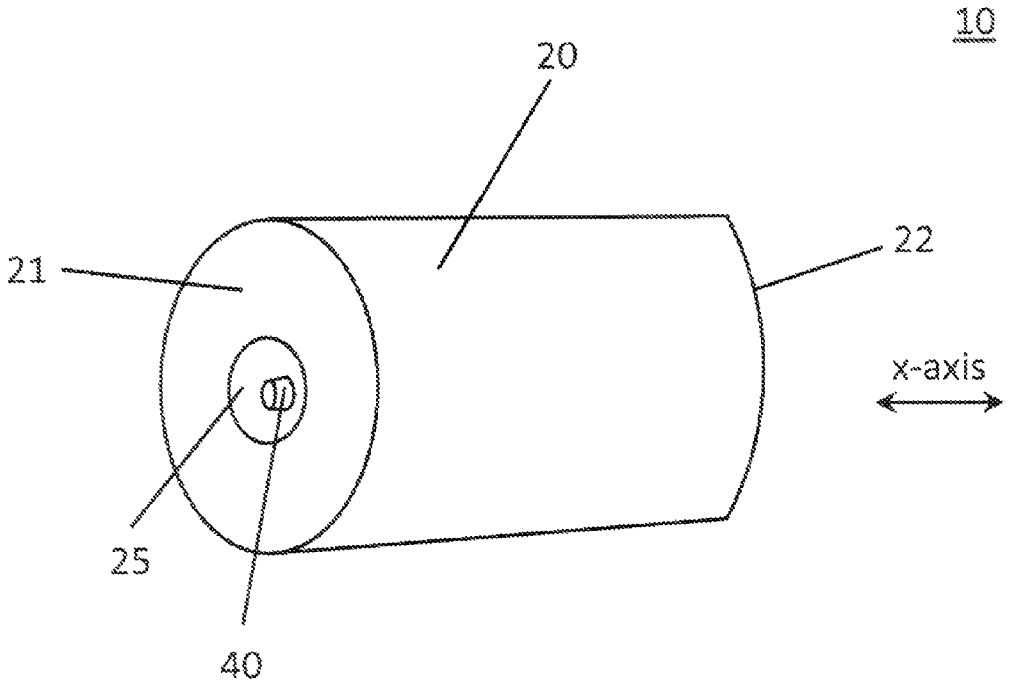
FIG. 1 is a perspective view of an unwrapped fire ignition flare disclosed herein.

A fire ignition flare and methods of making and using the fire ignition flare are described. The fire ignition flare is unique in that it provides improved performance over conventional devices while enabling fire personnel to attack a fire from a remote location, thus providing distance and safety to frontline fire personnel. Additionally, the fire ignition flare can be about 2.5 times smaller in size and about ⅔ the weight of conventional devices. The compact and lightweight design of the fire ignition flare allows a greater quantity of flares to be easily packed and carried by fire personnel. Further, the fire ignition flare travels more than 2 times the distance and burns 3 times longer than conventional devices. Finally, the fire ignition flare is bidirectional, which greatly simplifies the loading of the flare, especially in dark conditions typically encountered during forest fires.

As shown in FIGS. 1-5, a fire ignition flare 10 is described. The fire ignition flare 10 can include an elongated, combustible body 20 and a fuse 40 extending longitudinally through the combustible body 20. As used herein, all relative terms are based on the fire ignition flare itself regardless of the orientation of the device. As used herein, "longitudinal" refers to the direction designated as the X-axis in FIG. 1.

The combustible body 20 can include a suitable pyrotechnic composition including at least one fuel and at least one oxidizer. Fuels can include any suitable material that can be oxidized sufficiently and rapidly enough to produce heat and/or a flame sufficient to ignite a fire. The oxidizer can include inorganic oxidizers such as perchlorates, chlorates and nitrates. The perchlorates, chlorates and nitrates can also include an alkali metal, an alkaline earth metal, or similar elements and compounds. For example, oxidizers can include, without limitation, potassium perchlorate, ammonium perchlorate, potassium nitrate, sodium nitrate, barium nitrate, potassium chlorate, barium chlorate and strontium nitrate. The combustible body 20 can also include a mixture of more than one oxidizer. For example, the oxidizer can include a mixture of a perchlorate and a nitrate. The mixture can include a greater amount of perchlorate than nitrate in some embodiments and a greater amount of nitrate than perchlorate in others.

The pyrotechnic composition forming the combustible body 20 can also include additives such as catalysts, binders, curing agents, fillers and combinations thereof. In some embodiments, the combustible body 20 can include a binder that serves the dual purpose as a fuel and a binder. In some embodiments, the fuel, binder, or binder-fuel can include resins, such as synthetic and natural resins. For example, the resin can include an epoxy resin, such as ARALDITE epoxy resins available from Huntsman, such as ARALDITE GY 240, GY 261, GY 2600, GT 6609, GT 7077, GT 1804, GT 8010, GZ 7488, GZ 601, D.E.R. liquid epoxy resins and D.E.N. epoxy novolac resins available from DOW, such as D.E.R. 331, 383, 732, 736, and CHEMRES epoxy resins available from PolyStar LLC, such as CHEMRES 601, 611, 612, 634, 635, 640, 650. Alternatively or additionally, the resin can include polyester resins, fiberglass resins, other resins, and combinations thereof.

In some embodiments, the combustible body 20 can include a catalyst to improve the burn rate or stability of the fire ignition flare 10. Catalysts can include transition metal salts and complexes and other metal ion sources, such as metal oxides. For example, the catalyst can include aluminum powder, manganese dioxide and iron oxide, e.g., iron (III) oxide (such as grey iron oxide) and iron (II, III) oxide (such as black iron oxide).

In some embodiments, the combustible body 20 can be a solid pyrotechnic composition and the composition can include a curing agent. In some embodiments, the curing agent can include modified polyamines and modified aliphatic amines, such as ARADUR hardeners available from Huntsman, such as ARADUR 10, 21, 45, 100, 450, 837, 2958, 3440, 3740, and CHEMCURE hardeners available from PolyStar LLC, such as CHEMCURE 202, 211, 224, 230, 250F, 263, 272, and other hardeners, such as Methyl Ethyl Ketone Peroxide (MEKP). For example, the combustible body 20 can include an oxidizer, a fuel or both suspended within a cured epoxy matrix. The combustible body 20 can also include one or more oxidizers and/or fuels and additives suspended within a cured epoxy matrix.

The composition of the combustible body 20 can be adjusted to achieve a desired burn rate or stability of the fire ignition flare 10. In one embodiment, the combustible body 20 can be, or can be formed from, a curable composition that includes 40-80 wt-% of a perchlorate, 5-30 wt-% of a nitrate, 0.25-10 wt-% of a catalyst, 5-30 wt-% of a resin, and 2.5-15 wt-% of a curing agent. The perchlorate can be an alkali metal perchlorate and the nitrate can be an alkali metal nitrate. The catalyst can be a metal oxide. The resin can be an epoxy resin. The curing agent can be a modified polyamine or another hardener corresponding to the epoxy resin.

In another embodiment, the combustible body 20 can be, or can be formed from, a curable composition that includes 50-80 wt-% of a perchlorate, 10-30 wt-% of a nitrate, 2-8 wt-% of a catalyst, 10-30 wt-% of a resin, and 5-15 wt-% of a curing agent. In another embodiment, the combustible body 20 can be or can be formed from a curable composition that includes 50-80 wt-% of potassium perchlorate, about 15-25 wt-% of sodium nitrate, about 3-7 wt-% of iron oxide, about 15-25 wt-% of resin, and about 7-12 wt-% of curing agent.

The fuse 40 can include any suitable pyrotechnic initiating device, including time delay and ignition devices. For example, the fuse 40 can include a burning fuse in the form of a cord. The fuse 40 can include a relatively rigid material. As used herein, the term "relatively rigid" with respect to a fuse refers to a material maintaining a generally straight shape at rest and requiring additional force to bend. The fuse 40 can also include a cord formed from multiple layers, including a core and at least one outer layer. The core can include black powder, metallic spark compositions, other combustible compositions, and combinations thereof. The fuse 40 can also be waterproof. In some embodiments, the fuse 40 can include a black powder core, one or more layers of string wound around the core, and an outermost layer of a waterproof material, e.g., a lacquer, such as, a nitrocellulose lacquer. Examples of such a fuse 40 include, but are not limited to, visco fuses, lacquered/waterproof fuses, crackling fuses, and flying fish fuses.

Figure 3:
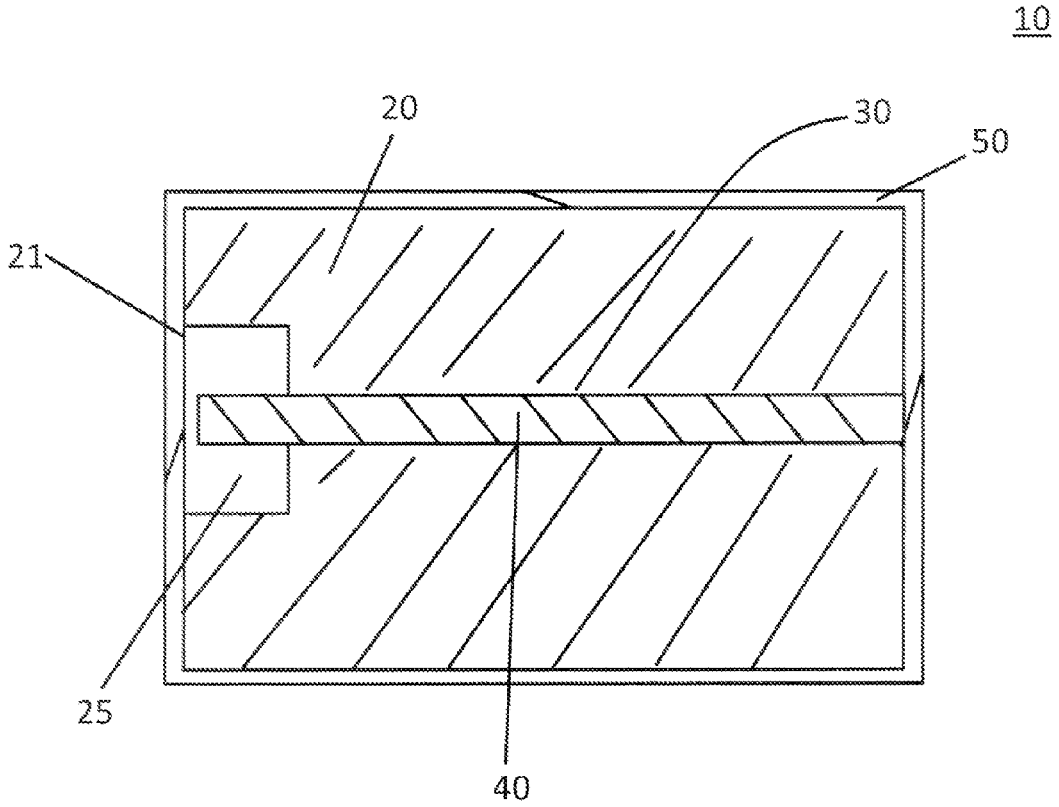
FIG. 3 is a cross-sectional view of the fire ignition flare of FIG. 2 along cut line 3-3.

As shown in FIG. 3, a fuse 40 can extend longitudinally through the combustible body 20. The combustible body 20 can be bonded to the fuse 40 along a bonded portion 30 of the fuse 40. The bonded portion 30 can include an interface between the combustible body 20 and the fuse 40. Accordingly, at least a portion of the fuse 40 or a main portion of the fuse 40 can be in contact with the combustible body 20, e.g. there is no canister or similar cavity preventing the fuse from reacting with the pyrotechnic composition of the combustible body 20. In some embodiments, the bonded portion 30 is at least 75% of the length of the fuse 40. In other embodiments, the bonded portion 30 can be at least 80% or at least 90% of the length of the fuse 40.

In some arrangements, an end portion of the fuse 40 extends from or is otherwise separated from the combustible body 20 and the bonded portion 30 includes the remaining portion of the fuse 40. Thus, the fuse 40 can provide both a time delay and ignition function for the fire igniting flare 10. As shown in FIG. 3, a first end 21 of the combustible body 20 can include a concave portion 25, and the fuse 40 can extend from the concave portion 25.

Figure 4:
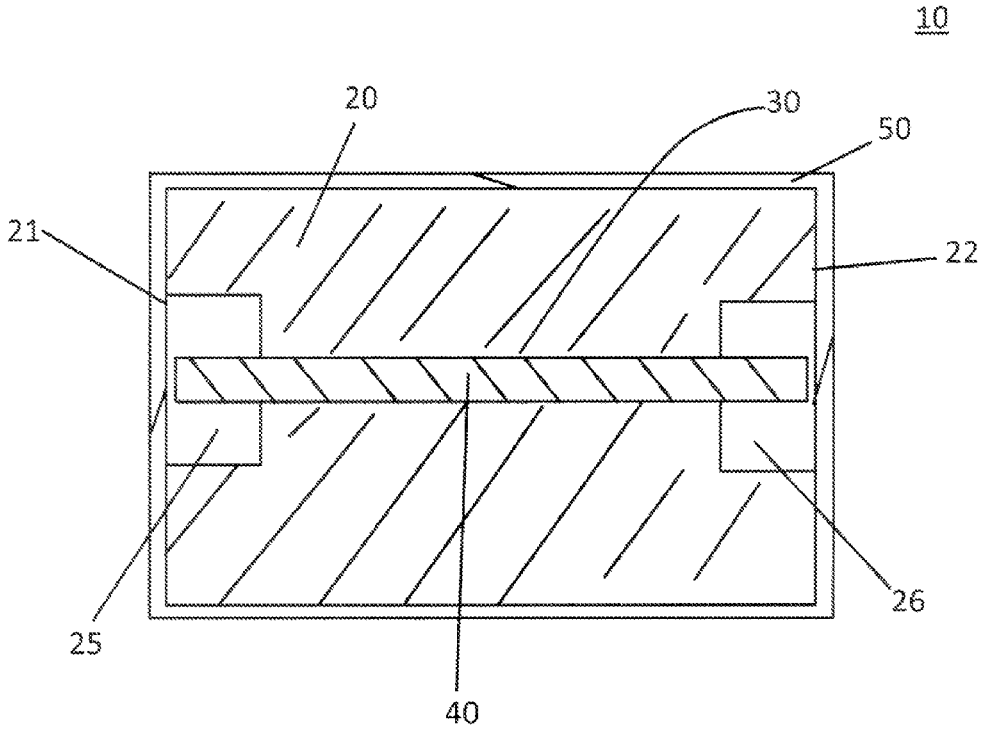
FIG. 4 is a cross-sectional view of a fire ignition flare disclosed herein with first and second concave portions.

In some embodiments, the combustible body 20 can also include a second concave portion 26. As shown in FIG. 4, the combustible body 20 can include a second end 22 opposite the first end 21. The second end 22 can include the second concave portion 26. The concave portions 25, 26 can include any suitable shape, including the form of a cone, a pyramid, or a frustum thereof. Concave portions 25, 26 in the form of a pyramid can include a base, such as a polygonal base having any number of sides, including without limitation, a triangle, a square, a pentagon, a hexagon, a heptagon and an octagon. The concave portions 25, 26 can also include cylindrical or rectangular prism shapes.

When the fire ignition flare 10 includes first and second concave portions 25, 26 with opposite ends of the fuse 40 extending from each of the portions 25, 26, the fire ignition flare 10 can be initiated from either end, providing the ability to interchangeably load the flare 10 into an initiating device with either end facing out. Thus, a user is able to load the fire ignition flare 10 bidirectionally without having to visualize the flare 10 prior to loading into the launching device. This can increase the efficiency and accuracy for fire personnel using the fire ignition flare 10, who may require quick actions and may be working in dark or smoky conditions, by eliminating the need—and additional time—to determine which end of a flare must be loaded first.

The fire ignition flare 10 can also include a protective wrapping 50 for safety and shipping purposes. The wrapping 50 can protect the combustible body 20 and the fuse 40 from moisture, light, accidental ignition and other undesirable reactions. The wrapping 50 can cover a portion of or the entire combustible body 20 and the fuse 40. The wrapping 50 can be the outermost layer of the fire ignition flare 10 as shown in FIGS. 2-5. In embodiments including a wrapping 50 covering the first end 21 or the second end 22 of the combustible body, an initiating device, e.g. a charge or a blank, can break through the wrapping 50 at either end 21, 22 to light the fuse 40 of the fire ignition flare 10.

The wrapping 50 can include a foil, such as an aluminum foil. For example, the foil wrapping 50 can be a 0.5 mil aluminum foil, a 3 mil aluminum foil, or a 5 mil aluminum foil. Alternatively or additionally, the wrapping can include mylar, shrink wrap, polyvinyl chloride (PVC) liner, and combinations thereof. The wrapping 50 can also include an adhesive material. For example, at least a portion of the wrapping 50 can include aluminum foil tape.

Figure 2:
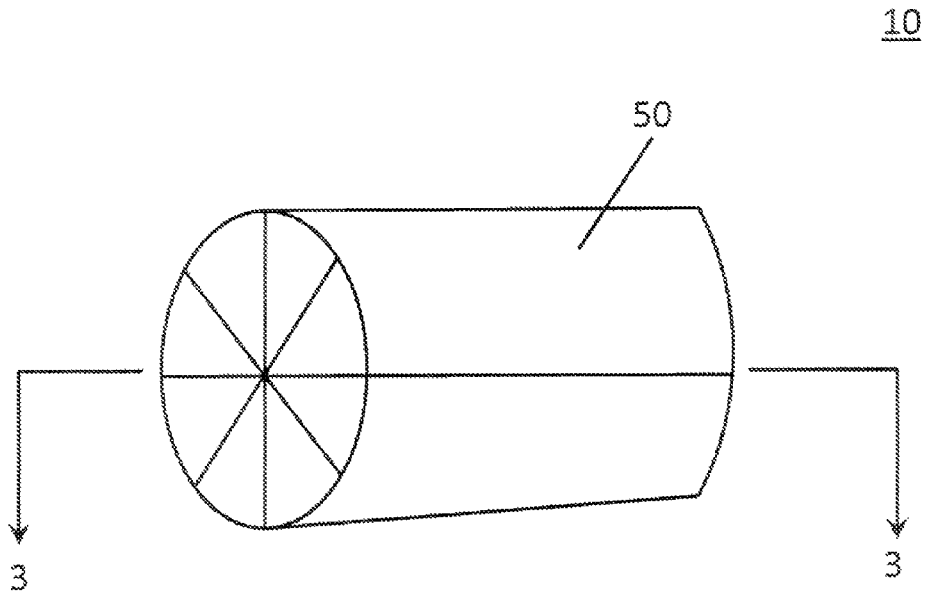
FIG. 2 is a perspective view of a wrapped fire ignition flare disclosed herein.
Figure 5:
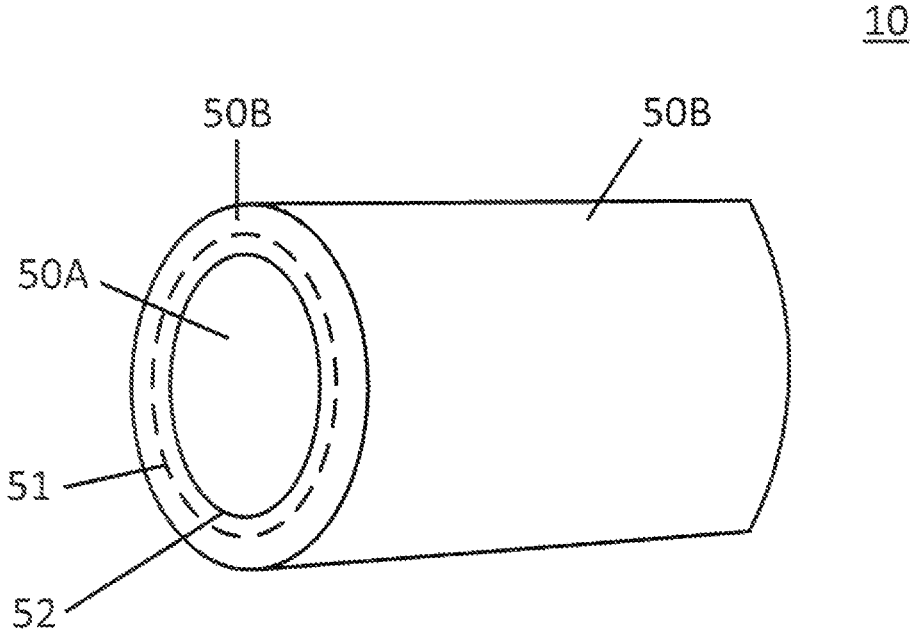
FIG. 5 is a perspective view of a wrapped fire ignition flare disclosed herein.

In some embodiments as shown in FIG. 2, the wrapping 50 can be formed from one piece of material. In other embodiments, the wrapping 50 can be formed from more than one piece of material. For example as shown in FIG. 5, the wrapping 50 can include a first wrapping portion 50A and a second wrapping portion 50B. The first wrapping portion 50A can cover the first end 21 of the combustible body 20, the second end 22 of the combustible body 20, or both. The second wrapping portion 50B can cover the remaining portions of the combustible body 20.

The second wrapping portion 50B can at least partially overlap with and/or secure to the first wrapping portion 50A. For example as shown in FIG. 5, the dotted line 51 indicates an edge of the first wrapping portion 50A that is underneath the second wrapping portion 50B. An outer circumference 51 of the first wrapping portion 50A can be greater than an inner circumference 52 of the second wrapping portion 50B, such that the portions 50A, 50B overlap at an end of the flare 10 to produce a waterproof seal.

The first and second wrapping portions 50A, 50B can be different materials. In one embodiment, the first wrapping portion 50A can include an aluminum foil tape and the second wrapping portion 50B can include mylar, shrink wrap, or PVC liners. The foil wrapping 50A can be secured over one or both ends 21, 22 with adhesive and/or by the overlapping second wrapping portion 50B.

Protective wrapping 50 of the fire ignition flare 10 advantageously provides a water resistant barrier for the combustible body 20 and fuse 40, and allows the fire ignition flare 10 to be fired and ignited even if the flare 10 has been previously exposed to moisture, such as being exposed to rain or submersed in water. In particular, wrapping 50 can protect the combustible body 20 and fuse 40 from distortion and other detrimental effects from exposure to moisture and other hazards.

The fire ignition flare 10 can also be partially or fully combustible. As used herein, the term "fully combustible" with respect to the fire ignition flare refers to the combustible nature of substantially all of the components of the device including, if applicable, any wrapping. This allows substantially all of the components of the fire ignition flare to burn off or otherwise decompose, providing environmental benefits by reducing or avoiding debris in wildlands due to fire ignition flares launched into remote areas.

Figure 6:
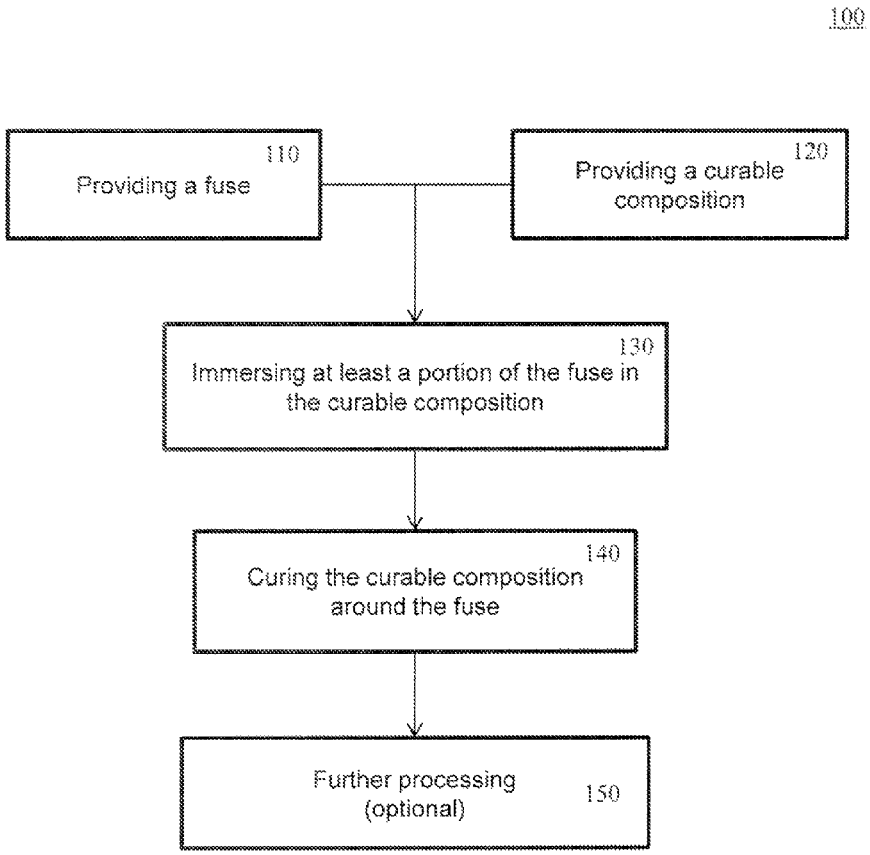
FIG. 6 is a flow chart showing a method of making a fire ignition flare disclosed herein.

A method of making a fire ignition flare is also described. As shown in FIG. 6, the method 100 can include providing a fuse 110 and providing a curable composition 120. The curable composition can include pyrotechnic compositions as discussed above. In particular, the curable composition can include a curable resin, a curing agent, a fuel, and an oxidizer. The curable resin and the fuel can also be the same material, such as a cured epoxy resin. The curable composition can also include a catalyst.

Figure 7:
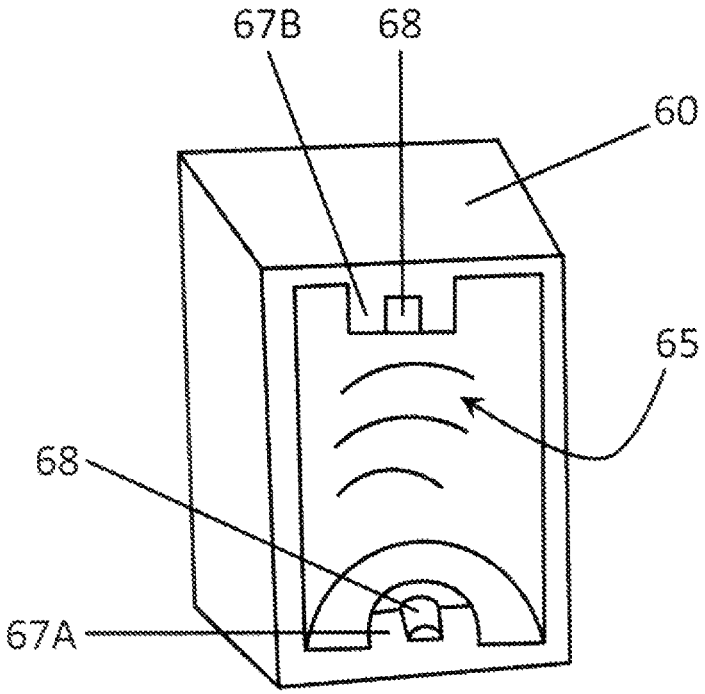
FIG. 7 is a perspective view of half of a mold for a fire ignition flare disclosed herein.

The method 100 can also include immersing at least a portion of the fuse in the curable composition 130. The immersing step 130 can include filling a mold with the curable composition and positioning the fuse to extend out of the mold. FIG. 7 shows one half of a mold 60 that can be used to make the fire ignition flare. The other half of the mold 60 can be similar or a mirror image of the first half. The mold 60 can include a mold cavity 65 for receiving the curable composition. The mold 60 can include a generally elongated shape and provide for at least one concave portion at a first end of the mold. The mold 60 can also provide for a first concave portion at the first end and a second concave portion at a second end of the mold 60. For example, the mold 60 can include a projection 67A at a first end of the mold 60 for forming a first concave portion. The mold 60 can also include a second projection 67B at a second end of the mold 60 for forming a second concave portion. Either or both of the projections 67A, 67B can also include an indentation 68 for receiving at least a portion of a fuse, such as the fuse tip, and preventing the covering thereof with the curable composition.

The method 100 can also include curing the curable composition around the fuse 140. For example, all components can be mixed and then injected into the mold at step 130 and allowed to cure at step 140. Alternatively, step 130 can include filling the mold with a mixture of curable resin, fuel and oxidizer, and step 140 can include introducing the hardener into a mixture, for example injecting the hardener into the mold.

The method can also include further processing steps 150 for the fire ignition flare including removing the cured composition from the mold, trimming one or more exposed ends of the fuse, and wrapping the cured composition in a protective wrapping.

In some embodiments, the fire ignition flare 10 can be configured for use with a launching device. Launching devices can include starter pistols, flare guns, and other projectile launching mechanical devices. For example, the fire ignition flare 10 can be elongated with a length of about 1-2 inches and a width of about 0.3-1.5 inches such that the flare can fit within the barrel of a launching device. In one embodiment, the fire ignition flare 10 can be substantially cylindrical and can measure about 1.5 inches in length and about 0.920 inches in diameter. The combustible body 20 can include a first concave portion 25 measuring about 0.400 inches in diameter at the widest part and about 0.255 inches in depth. The fuse 40 can include a diameter of about 3/32 inches and a length of about 1.5 inches. The combustible body 20 and fuse 40 can be wrapped in a protective wrapping 50. The wrapping 50 can cover the entire flare 10 and include mylar, shrink wrap, aluminum foil, and combinations thereof. At least the first end 21 can include a wrapping portion 50A of aluminum foil, for example a 0.5 mil adhesive foil. In another embodiment, the combustible body 20 can also include a second concave portion 26 with dimensions similar to the first concave portion 25. The second end 22 can also include a foil wrapping portion 50A.

Figure 8:
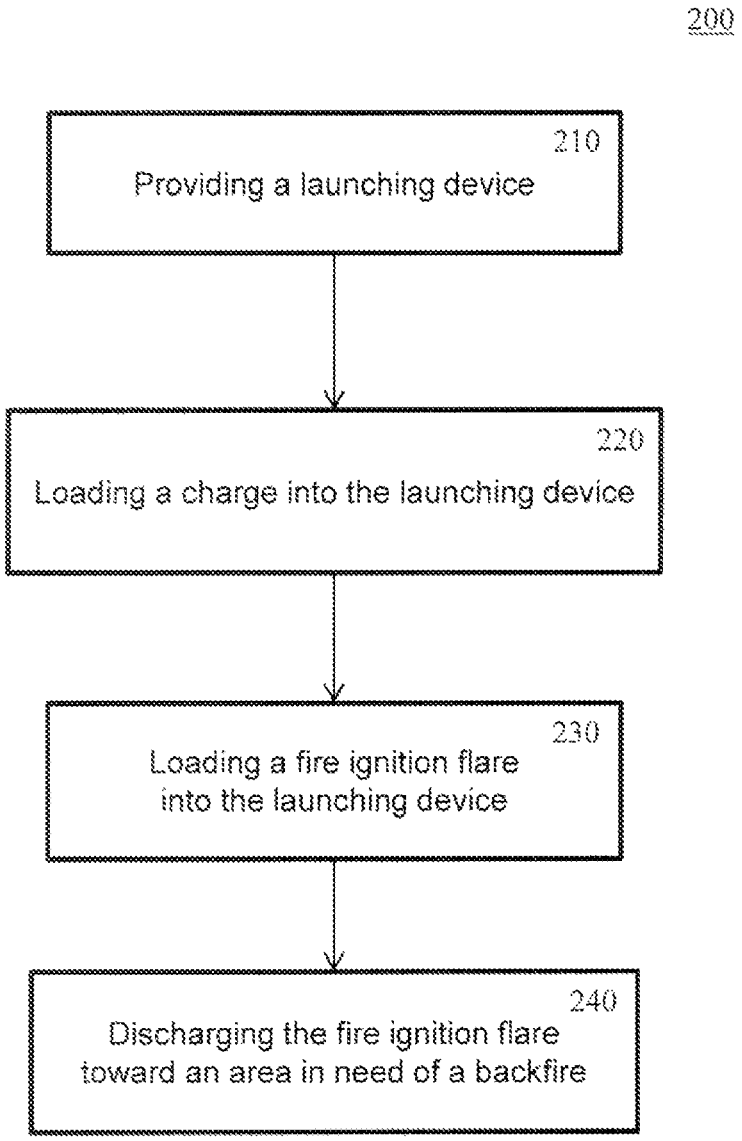
FIG. 8 is a flow chart showing a method of igniting a backfire disclosed herein.

A method of igniting a backfire or other prescribed burn is also described. As shown in FIG. 8, the method 200 can include providing a launching device 210, loading a fire ignition flare into the launching device 230, and discharging the fire ignition flare 240. The launching device can include a barrel adapted for firing a projectile. In some instances, the method can also include loading a charge into the launching device 220.

The discharging step can include simultaneously launching and igniting, e.g. lighting the fuse, the fire ignition flare 10. At least a portion of the fuse 40 can provide a time delay for ignition of the combustible body. Upon ignition, the fire ignition flare 10 projects a pressurized flame pattern from the interior of the device outward and can burn for about 45-60 seconds or more. The burn rate can be adjusted based on the dimensions and composition of the combustible body 20.

The fire ignition flare 10 can be discharged toward an area in need of a backfire or other prescribed burn. Due to the unique configuration, the fire ignition flare 10 can achieve significantly improved trajectories compared with conventional flares. The fire ignition flare 10 can be launched distances of greater than 250 feet, 300 feet, 400 feet, 500 feet and more. In particular, the fire ignition flare 10 has achieved trajectories of about 420-600 feet using a .22 caliber industrial load starter pistol as a launching device. Such distances can provide additional safety for fire personnel, allowing them to reach even more remote and difficult to access locations, and avoid the need to employ more costly techniques such as ignition device deployment by aircraft.

EXAMPLES

A plurality of fire ignition flares were produced from a curable composition comprising 50.2 wt-% of potassium perchlorate, 16.7 wt-% of sodium nitrate, 4.2 wt-% of iron oxide, 20.0 wt-% of resin, and 8.8 wt-% of hardener. For each flare, a fuse was placed in a mold and the curable composition was poured into the mold and allowed to cure. A first end of each combustible body was covered with commercially available adhesive foil tape, including Aluminum Foil Tape 3350 and 3381 from 3M or Aluminum Foil Tape from Intertape Polymer Group (IPG). The remainder of the combustible body was covered with a mylar wrapping material.

Each of the cured fire ignition flares were then placed in a flare gun over a blank and fired. Upon launching the fire ignition flare, the foil cap was pierced, the fuse was ignited, the flare was launched and subsequently ignited the product. The fire ignition flare has proven to burn successfully in various climates and terrains. In fact, the fire ignition flare has successfully burned despite being completely covered/buried by moist sand.

In a comparative test, the example fire ignition flares and commercially available conventional devices (FIREQUICK FLARE SYSTEMS flares from Firequick Products, Inc.) were repeatedly launched under the same conditions. In particular, each type of flare was launched from a .22 caliber starter pistol with a modified barrel using #4 load blanks and #6 load blanks. Multiple repetitions of each type of flare were fired using each type of load.

On average, the conventional devices burned for 15-20 seconds. The conventional devices had a trajectory of between 150-200 feet using the #4 load and up to 240 feet using the #6 load. In contrast, the example fire ignition flares burned for 45 seconds to 1.5 minutes. The example fire ignition flares had a trajectory of between 350-420 feet using the #4 load and at least 500 feet using the #6 load.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A fire ignition flare, comprising:

an elongated, unitary combustible body;

a combustible fuse extending longitudinally through the combustible body, and a protective wrapping, wherein said combustible body is bonded to the combustible fuse along a bonded portion, and a first end of the combustible body comprises an indented portion, wherein an unbonded portion of the combustible fuse extends into the indented portion of the combustible body, wherein the protective wrapping covers the entire combustible body, including the indented portion, and the combustible fuse.

2. The fire ignition flare according to claim 1, wherein the protective wrapping is the outermost layer of the fire ignition flare.

3. The fire ignition flare according to claim 1, wherein the bonded portion comprises an interface between the combustible body and the combustible fuse.

4. The fire ignition flare according to claim 1, wherein the combustible body further comprises a second end, opposite the first end, wherein the second end comprises a second indented portion and the combustible fuse extends from the second indented portion.

5. The fire ignition flare according to claim 1, wherein the combustible body comprises an oxidizer suspended within a cured resin.

6. The fire ignition flare according to claim 1, wherein the combustible body comprises:

40-80 wt-% of a perchlorate oxidizer;

5-30 wt-% of a nitrate oxidizer;

0.25-10 wt-% of a metal ion catalyst;

5-30 wt-% of a resin; and 2.5-15 wt-% of a curing agent.

7. The fire ignition flare according to claim 6, wherein the perchlorate oxidizer is selected from the group consisting of potassium nitrate, strontium nitrate, barium nitrate, potassium perchlorate, ammonium perchlorate, potassium chlorate, barium chlorate, ammonium nitrate and mixtures thereof.

8. The fire ignition flare according to claim 6, wherein the nitrate is selected from the group consisting of strontium nitrate, barium nitrate, sodium nitrate, potassium nitrate, ammonium nitrate and mixtures thereof.

9. The fire ignition flare according to claim 6, wherein the metal ion catalyst is selected from the group consisting of aluminum powders, iron oxide, manganese dioxide, and mixtures thereof.

10. The fire ignition flare according to claim 6, wherein the resin is an epoxy resin.

11. The fire ignition flare according to claim 1, wherein the combustible body comprises:

40-80 wt-% of an alkali metal perchlorate;

5-30 wt-% of an alkali metal nitrate;

0.25-10 wt-% of a metal oxide;

5-30 wt-% of a resin; and 2.5-15 wt-% of a curing agent.

12. The fire ignition flare according to claim 1, the protective wrapping comprises a material selected from the group consisting of an adhesive material, a foil, mylar, shrink wrap, PVC liner and combinations thereof.

13. The fire ignition flare according to claim 1, wherein the fire ignition flare is configured to be fired from a launching device, and wherein the fire ignition flare is configured so the unbonded portion of the fuse is ignited when the fire ignition flare is fired from a launching device.

14. The fire ignition flare according to claim 1, wherein the protective wrapping renders the fire ignition flare waterproof.

15. The fire ignition flare according to claim 1, wherein a combustible fuse extends longitudinally through substantially the full length of the combustible body.

* * * * *